US008050791B2

(12) United States Patent
Li

(10) Patent No.: US 8,050,791 B2
(45) Date of Patent: Nov. 1, 2011

(54) METHOD OF FABRICATING COLOR JACQUARD FABRIC

(75) Inventor: Jialin Li, Hangzhou (CN)

(73) Assignees: Silk Road Holding Group Co. Ltd., Huzhou, Zhejiang Province (CN); Zhejiang Sci-Tech University, Hangzhou, Zhejiang Province (CN)

( * ) Notice: Subject to any disclaimer, the term of this patent is extended or adjusted under 35 U.S.C. 154(b) by 1212 days.

(21) Appl. No.: 11/744,996

(22) Filed: May 7, 2007

(65) Prior Publication Data

US 2007/0263008 A1 Nov. 15, 2007

(30) Foreign Application Priority Data

May 11, 2006 (CN) ..... 2006 1 0078743

(51) Int. Cl.
*G06F 19/00* (2006.01)

(52) U.S. Cl. ..... 700/133; 700/131; 700/140

(58) Field of Classification Search ..... 700/133, 700/130, 131, 135, 140; 139/333, 318, 319
See application file for complete search history.

(56) References Cited

U.S. PATENT DOCUMENTS 3,671,944 A * 6/1972 Dubner ..... 700/131
3,744,035 A * 7/1973 Geirhos et al. ..... 700/131
4,078,253 A * 3/1978 Kajiura et al. ..... 700/131
4,172,475 A * 10/1979 Schwarz et al. ..... 139/66 R
4,958,664 A * 9/1990 Oppl et al. ..... 139/435.1
5,058,174 A * 10/1991 Carroll ..... 382/111
5,200,904 A * 4/1993 Tottman ..... 700/131
5,386,854 A * 2/1995 Hacker ..... 139/85
5,388,050 A * 2/1995 Inoue et al. ..... 700/131
5,557,527 A * 9/1996 Kotaki et al. ..... 700/131
5,582,213 A * 12/1996 Okawa ..... 139/46
5,678,612 A * 10/1997 Derudder et al. ..... 139/65
5,719,777 A * 2/1998 Kotaki ..... 700/131
5,755,267 A * 5/1998 Eberhard et al. ..... 139/1 E
5,794,665 A * 8/1998 Keim ..... 139/455
5,829,487 A * 11/1998 Thomas et al. ..... 139/319
6,185,475 B1 * 2/2001 Chung ..... 700/131
6,865,439 B1 * 3/2005 Tu ..... 700/131
7,203,566 B2 * 4/2007 Terai et al. ..... 700/141
7,272,244 B2 * 9/2007 Saporiti et al. ..... 382/111
7,310,565 B2 * 12/2007 Vergote et al. ..... 700/140

* cited by examiner

*Primary Examiner* — Danny Worrell
(74) *Attorney, Agent, or Firm* — Global IP Services; Tianhua Gu

(57) ABSTRACT

This invention discloses a method of fabricating color jacquard fabric, comprising the processes of design and fabrication of pattern card, loom preparation, looming and weaving. The steps of design and fabrication of pattern card are: reading target image for jacquard into a computer; adjusting the image and setting parameters; selecting pixel value according to image dimensions; modifying the image; dividing the modified target image into motif image and auxiliary pattern around the motif image, designing and making the pattern card of motif image and auxiliary pattern of different design characteristics by jacquard design software; and finally combining said two pattern cards into a pattern card that represents the image and pattern of different characteristics in one fabric with corresponding warp and filling yarns. The invention can provide vivid lifelike picture of fabric, integrating rich color representation and artful pattern.

16 Claims, 3 Drawing Sheets

METHOD OF FABRICATING COLOR JACQUARD FABRIC

CROSS REFERENCE TO THE RELATED PATENT APPLICATION

This application claims the priority of the Chinese patent application No. 200610078743.6, filed on May 11, 2006.

FIELD OF THE INVENTION

This invention relates to a method of fabricating silk weaving fabric, especially a method of fabricating jacquard fabric of different characteristics that is suitable for weaving color fabric combining manual designed pattern card and computerized color-clustered image.

BACKGROUND OF THE INVENTION

Traditional color jacquard fabrics mainly represent natural colors of silk yarns in the form of float of warp and filling yarns of different colors. Such colors are simple. However, if color contents are rich, the warp and filling yarns of many different colors have to be used. For a classical example, a product of Hangzhou DuJinsheng Silk Weaving Mill adopts 15 shuttles to weave 15 colors in the pattern and represent scores of texture and color variation (normally colors represent the texture). Although traditional color jacquard pattern uses manual pattern processing and presents good 3-dimensional effect and flexibility, yet it lacks rich colors because it relies on the number of each texture to display a color. The invention patents (ZL99125610.7 and ZL00126505.9) of this inventor proposes a method of color clustering and texture combining to utilize only several color yarns and system textures to weave and represent complicated and plentiful pattern colors. The color-representing texture thus combined can reach thousands of varieties (larger number can be obtained theoretically). Such fabrics present an effect of color photo and painting that cannot be viewed in traditional technique, featuring a character of rich color variation and a breakthrough of technique and theory of modern jacquard design established by Europeans and used in more than a century. However, the pedestrian textures given by computers lack the flexibility of manual pattern processing in traditional designing method, such as changeful manual interlacing to embody elegant character of jacquard fabric.

SUMMARY OF THE INVENTION

This invention relates to a technical program and the method to solve the above-mentioned shortcoming by providing a method of fabricating color jacquard fabric with different characteristics. It combines both pattern cards of computerized color clustering and manual design and interlacing into one pattern card to enable the fabric to feature vivid lifelike picture, rich colors and artful design.

The technical program given in this invention to solve the existing problem is: a method of fabricating color jacquard fabric with different characteristics, with the following steps: (i) design and fabrication of pattern card; (ii) loom preparation; (iii) looming and weaving, wherein the present invention is characterized by the following steps of pattern card design and fabrication:

(1) Read target image for jacquard into a computer by scanner or digital camera;

(2) Adjust the image obtained and set relevant parameters;

(3) Select image pixel according to image dimensions with pixel value corresponding to the number of warp yarn and filling yarn;

(4) Conduct image modification and adjustment;

(5) Divide said modified image into two parts—motif image and auxiliary pattern around the motif image, conduct the design of image and pattern of different design characteristics with computer-aided jacquard design software and then fabricate the pattern card;

(6) Combine said two pattern cards completed to form a pattern card on which warp yarns and filling yarns correspondently display an image and pattern of different design characteristics, and save it to a file. In combining the pattern cards of vivid motif image and auxiliary pattern, pay attention to the coordination between warp and filling yarns order and texture at the joint of two pattern cards.

The main steps of designing and fabricating the pattern card of rich color image are:

A. Adjust the light-shade gradation of target image displayed in the computer and on the chromatogram, configure several colors to conduct color clustering as required;

B. Conduct color segmentation according to the configuration in the above-mentioned step A and combine with black & white into plentiful color combination, then input texture of pattern card successively as per light-shade relation.

C. Save the above-mentioned design to a pattern card file.

A step between B and C may be added that the pattern cards of several colors clustered in B should be stringed and combined to weave more colored fabric.

In pattern card fabrication, computerized image color clustering is adopted. Firstly cut down image colors to only several colors and then conduct color combination. As above said, color combination can provide more than a thousand of colors and these combined colors can form a lifelike weaving image to a verisimilitude extent greatly higher than common color jacquard with just scores of colors. Since the method needs only several kinds of color yarn (some tendentious color yarns may be added if needed), the fabric is characterized by easy fabrication, simple operation and freewill color combination.

The main steps of fabricating auxiliary pattern card are:

A. Conduct skeleton edge enhancement of auxiliary pattern according to design requirements and paint different colors onto different texture. The color of figure flat painting shall be identical to the color of edge enhancement. The color filled in edge enhancement may be selected at will so long as different colors are painted for different texture to show the distinction.

B. Add interlacing points at figure flat painting with non-simple circulating texture, that is, if no simple circulating texture is represented at figure flat painting, interlacing points should be necessarily added to limit overlong warp or filling yarn floats and simultaneously enhance expressive force. This kind of interlacing points consist of plate interlacing, cis interlacing and fancy interlacing as required, while manual interlacing should adopt cis interlacing and fancy interlacing to preferably embody jacquard characteristics.

C. By texture weaving software, save said auxiliary pattern to a file.

Though such woven fabrics have less color variation, yet they have strong 3-dimensional effect, flexible manual interlacing and excellent originality.

The steps of said loom preparation are as follows:

(1) Use one color yarn as warp or filling yarn from several color or black/white yarns required by the design, with other color yarns as the other yarn left in warp or filling yarn, and conduct the processes of warp beaming and cop winding;

(2) Adjust looming parameters according to varieties and specifications, such as the size, density and silk yarn variety.

Said steps of looming and weaving are: install the finished pattern card in the loom and start the loom to fabricate the color jacquard fabric of different design characteristics.

Said motif image relates to the image to design the pattern card in accordance with computerized color clustering. Both motif image and auxiliary pattern do not depend on their locations or occupied areas but depend on the means of forming, and the locations and occupied areas of both motif image and auxiliary pattern can be interchanged.

The advantages of this invention lie in that the fabrics produced by this invention can represent not only the beauty like manual interlacing but also the vivid and beautiful color interweaving effect of texture produced by computer software, namely, simultaneously representing: strong dimensional style of manual designed pattern, vivid shaping and rich color patterns designed by the method of computerized color clustering; patterns of fabrics are jointed skillfully, displaying colorful, vivid and lifelike picture with high ornamental value.

An embodiment of this invention is further explained in combination with the figures hereunder.

DETAILED DESCRIPTION OF THE INVENTION

Figure 1:
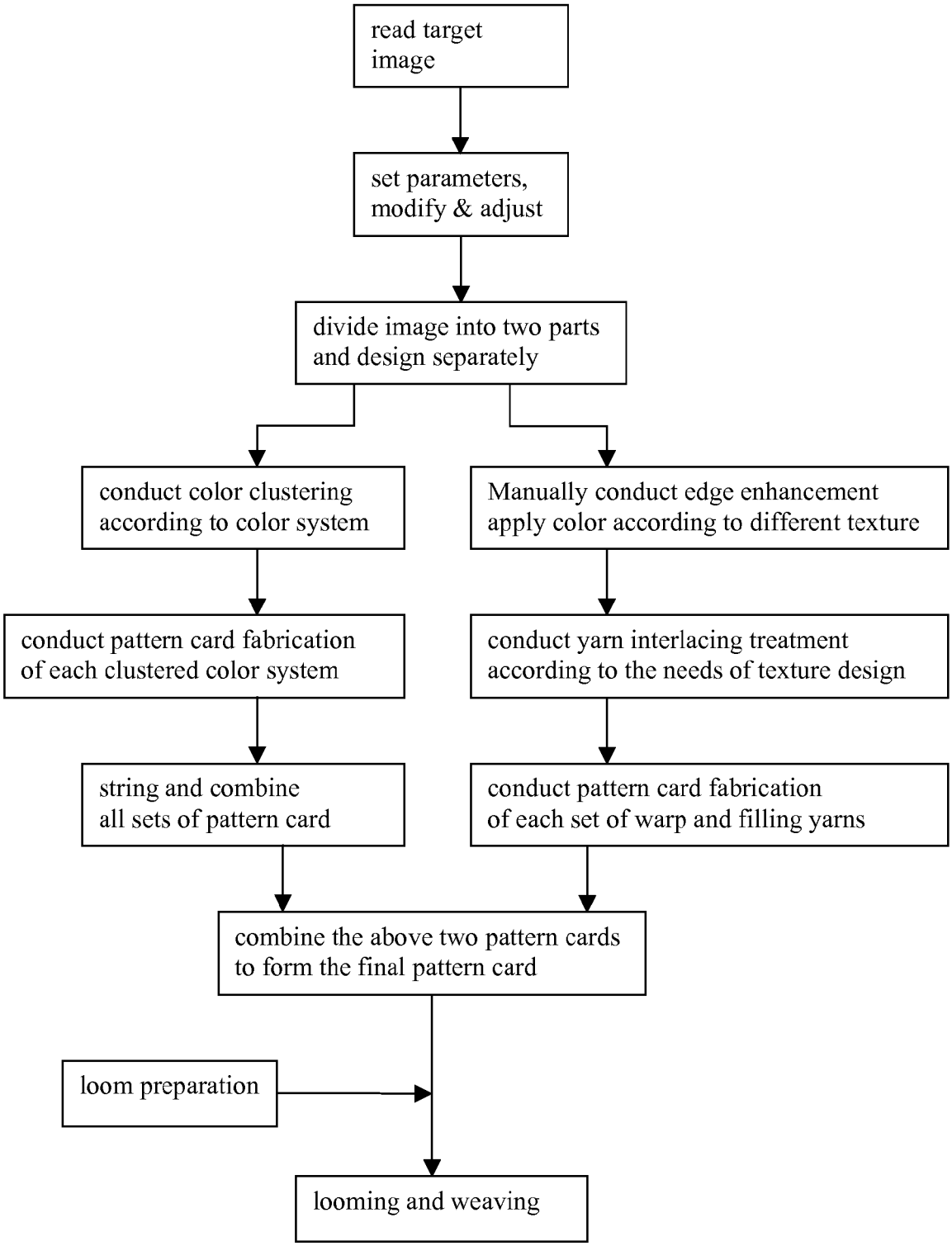
FIG. 1 is a flow chart of an embodiment of this invention.
Figure 2:
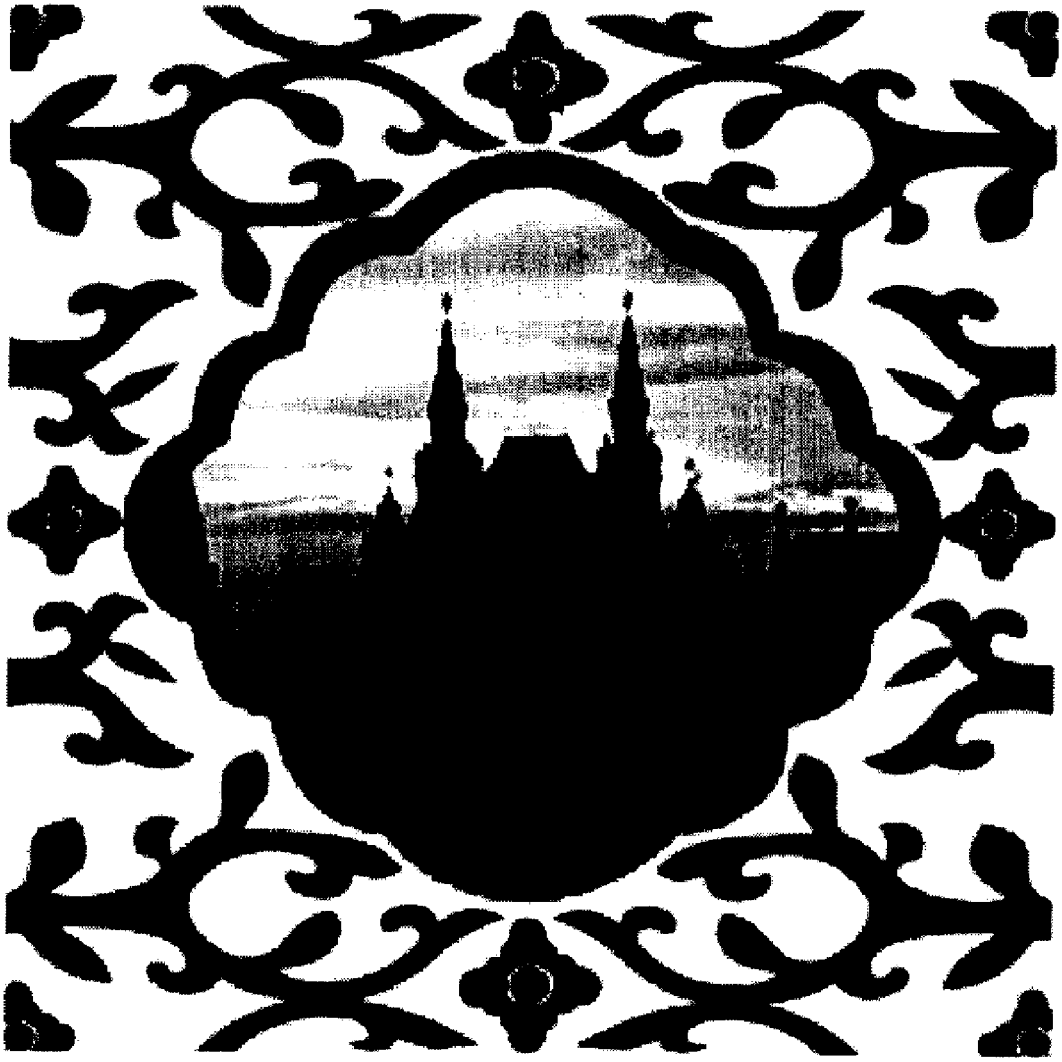
FIG. 2 is a schematic view of a fabric woven by the method of this invention.
Figure 3:
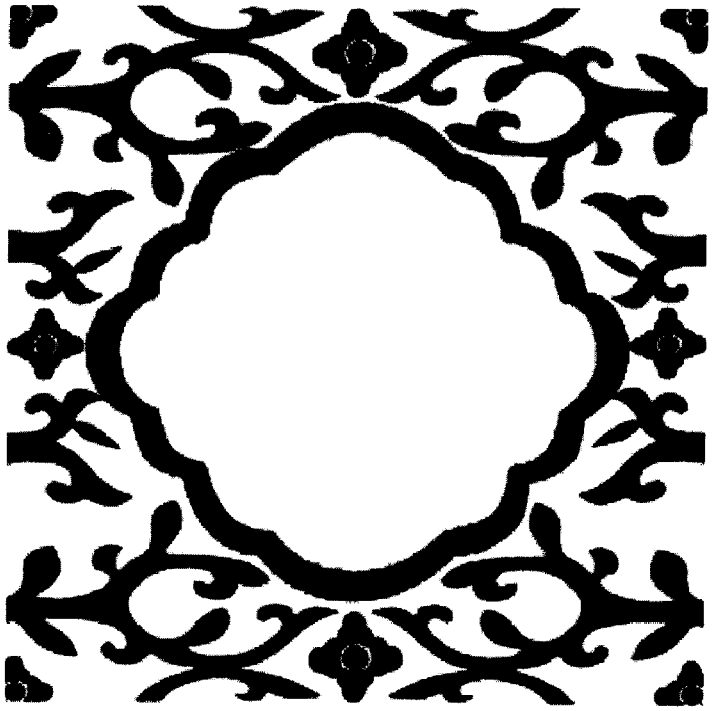
FIG. 3 is a schematic view of a fabric using manual pattern design of FIG. 2.
Figure 4:
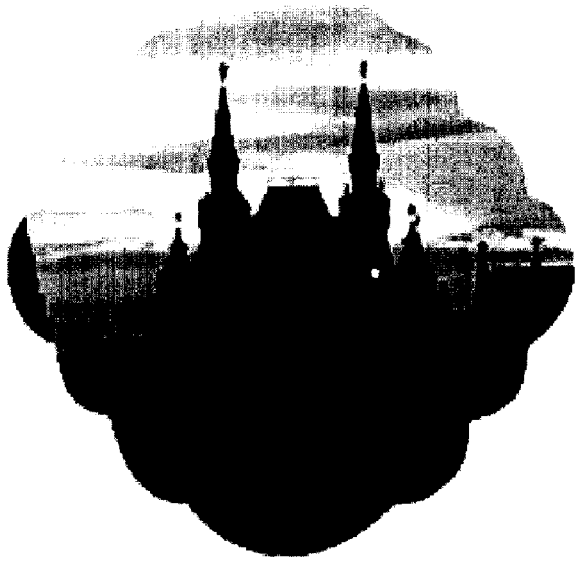
FIG. 4 is a schematic view of a fabric using computer color clustering of FIG. 2.

Embodiment: making a color scenery picture to a color jacquard photograph 27 cm wide and 20 cm high with framed and edging pattern. The design uses 3000 warp yarns (white) that adopt 2/22.2/24.4 dtex mulberry silk and 4000 filling yarns (scarlet, yellow mid, cyan blue and black) that adopt 40 dtex color nylon yarn. As shown in FIG. 1, the operating steps are:

1. Scan a color scenery picture (as shown in FIG. 2 and FIG. 4) with a color scanner connected to a computer, beginning with a preview;
2. Adjust scanning parameters according to the image of preview. In the case of 300 dpi resolution, the warp (longitudinal) pixels should be 3485 and weft (lateral) pixels 2450;
3. Adjust the color, brightness and contrast of the image scanned. Then make scanning and save the image in a disk;
4. Scan the edging pattern (as shown in FIG. 2 and FIG. 3) designed for frame and save the image in a disk;
5. Open professional computer-aided design software and conduct combined image design, mainly including image design, adjustment, treatment, cropping and despeckle, so as to ensure part of scenery picture to be positioned in the framed pattern, then adjust the combined image dimensions to 3000×2100 pixels;
6. After adjusting image dimensions, conduct color separation on scenery part in four procedures to obtain four color separation files (scarlet, yellow mid, cyan blue and black);
7. Open said image files in CAD software and conduct pattern card fabrication. For example, open red color separated image file in CAD software to configure it to several transitional textures from red to white. Then conduct such processes to yellow, blue and black color separated image files. As a result, every set of warp and filling yarns weaving constitutes a set of solid color pattern card with the variation of light and shade;
8. Combine said four pattern cards in the order of scarlet, yellow mid, cyan blue and black with the identical order to correspondent wefting yarns. If needed, the four color pattern cards can be stringed and combined in this step;
9. Open the file of edging pattern designed for frame and conduct pattern card fabrication;
10. Conduct skeleton edge enhancement of pattern design and paint different colors onto different texture of frame pattern. For example, if there are two textures of frame pattern design and a ground weave, white may be applied to ground weave, tangerine to pattern design A and golf green to pattern design B. Tangerine and golf green may be configured separately as a set of warp figure comprising mainly warp float and weft figure comprising mainly weft float. If figure flat painting is not simple circulating texture, manual yarn interlacing treatment may be conducted in design as needed with identical coloring of figure flat painting and skeleton edge enhancement;
11. Make the pattern card in accordance with the pattern design and texture configuration;
12. Combine the pattern cards made from step 5 to 7 and the pattern card made from step 8 to 11 to form a complete pattern card file, namely the combining of two matching pattern cards with precise coordination of order and structure at the joint of two pattern cards;
13. Finally input fabricated pattern card and relevant parameters in electronic jacquard loom for later use;
14. Install warp yarns and weft yarns. For warp yarns, adopt 3000 white mulberry silk yarns arranged in a density of 111 yarns per cm. For weft yarns, adopt scarlet, yellow mid, cyan blue and black nylon yarns with wefting order identical to correspondent pattern cards and arranged in a density of 50 yarns per cm×4 sets;
15. Start loom to weave a jacquard fabric that represents not only elegant sense of reality embodied by manual design cis interlacing but also rich color and lifelike scenery picture.

What is claimed is:

1. A method of fabricating color jacquard fabric, comprising: (i) design and fabrication of pattern card; (ii) loom preparation; (iii) looming and weaving, characterized by following steps of the design and fabrication of pattern card:

(1) Read target image for jacquard into a computer;

(2) Adjust the inputted image gotten from the step (1) and set parameters;

(3) Select image pixel value according to the inputted image dimensions;

(4) Modify and adjust the inputted image as a modified target image;

(5) Divide the modified target image into motif image and auxiliary pattern around the motif image, then use jacquard design software to design a pattern card of motif image and a pattern card of auxiliary pattern separately, which have different characteristics from each other;

(6) Combine the pattern card of motif image and the pattern card of auxiliary pattern according to corresponding warp and filling yarns, thereby to get a combining pattern card representing an image and pattern including all characteristics of both pattern cards in one breadth of fabric, and save the combining pattern card as a file.

2. The method of fabricating color jacquard fabric as claimed in claim 1, wherein steps of fabricating the pattern card of motif image are:

A. Adjust light shade gradation at the target color image displayed in the computer and set a number of colors to conduct color clustering as required;

B. Conduct color segmentation according to the configuration in the step A and combine with black & white into plentiful color combinations, then which are input into a texture of the pattern card successively per light-shade relation.

C. Save said design to a pattern card file.

3. The method of fabricating color jacquard fabric as claimed in claim 2, wherein coordination of warp and filling yarn ordering and texture at combining interface should be required in combining the pattern cards of motif image and auxiliary pattern.

4. The method of fabricating color jacquard fabric as claimed in claim 3, wherein steps of the loom preparation are as follows:

(1) Use one color yarn as warp or filling yarn from several color or black/white yarns required by the design, with other color yarns left as the filling or warp yarn, and conduct processes of warp beaming and cop winding;

(2) Adjust looming parameters according to variety specifications.

5. The method of fabricating color jacquard fabric as claimed in claim 4, wherein the steps of the looming and weaving are as follows: install the pattern cards fabricated on a loom and start the loom to weave color jacquard fabric of different characteristics.

6. The method of fabricating color jacquard fabric as claimed in claim 5, wherein the said variety specifications relate to the parameters of dimensions, density and yarn variety of the target fabric.

7. The method of fabricating color jacquard fabric as claimed in claim 1, wherein steps of fabricating the pattern card of motif image are:

A. Adjust light shade gradation at the target color image displayed in the computer and set a number of colors to conduct color clustering as required;

B. Conduct color segmentation according to the configuration in the step A and combine with black & white into plentiful color combinations, then which are input into texture of pattern card successively per light-shade relation.

C. String and combine pattern cards of several colors;

D. Save said design to a pattern card file.

8. The method of fabricating color jacquard fabric as claimed in claim 7, wherein coordination of warp and filling yarn ordering and texture at combining interface should be required in combining the pattern cards of motif image and auxiliary pattern.

9. The method of fabricating color jacquard fabric as claimed in claim 8, wherein steps of the loom preparation are as follows:

(1) Use one color yarn as warp or filling yarn from several color or black/white yarns required by the design, with other color yarns left as the filling or warp yarn, and conduct processes of warp beaming and cop winding;

(2) Adjust looming parameters according to variety specifications.

10. The method of fabricating color jacquard fabric as claimed in claim 9, wherein the steps of the looming and weaving are as follows: install the pattern cards fabricated on a loom and start the loom to weave color jacquard fabric of different characteristics.

11. The method of fabricating color jacquard fabric as claimed in claim 10, wherein the variety specifications relate to the parameters of dimensions, density and yarn variety of the target fabric.

12. The method of fabricating color jacquard fabric as claimed in claim 1, wherein steps of fabricating the pattern card of auxiliary pattern are:

A. Conduct skeleton edge enhancement of the auxiliary pattern according to design requirement, filling different colors onto the different texture inside the skeleton, identically coloring figure flat painting and skeleton edge enhancement B. Add interlacing points on figure flat painting of non-simple circulated texture;

C. Save the above-mentioned auxiliary pattern to a pattern card file in jacquard design software.

13. The method of fabricating color jacquard fabric as claimed in claim 12, wherein coordination of warp and filling yarn ordering and texture at combining interface should be required in combining the pattern cards of motif image and auxiliary pattern.

14. The method of fabricating color jacquard fabric as claimed in claim 13, wherein steps of the loom preparation are as follows:

(1) Use one color yarn as warp or filling yarn from several color or black/white yarns required by the design, with other color yarns left as the filling or warp yarn, and conduct processes of warp beaming and cop winding;

(2) Adjust looming parameters according to variety specifications.

15. The method of fabricating color jacquard fabric as claimed in claim 14, wherein the steps of the looming and weaving are as follows: install the pattern cards fabricated on a loom and start the loom to weave color jacquard fabric of different characteristics.

16. The method of fabricating color jacquard fabric as claimed in claim 15, wherein the said variety specifications relate to the parameters of dimensions, density and yarn variety of the target fabric.

* * * * *